US006253903B1

(12) United States Patent
Takahashi

(10) Patent No.: US 6,253,903 B1
(45) Date of Patent: Jul. 3, 2001

(54) CONVEYING APPARATUS

(75) Inventor: Kazuhiro Takahashi, Koshigaya (JP)

(73) Assignee: Omori Machinery Co., Ltd. (JP)

( * ) Notice: Subject to any disclaimer, the term of this patent is extended or adjusted under 35 U.S.C. 154(b) by 0 days.

(21) Appl. No.: 09/415,520

(22) Filed: Oct. 7, 1999

(30) Foreign Application Priority Data

Oct. 16, 1998 (JP) ..... 10-295028

(51) Int. Cl.[7] ..... B65G 47/26
(52) U.S. Cl. ..... 198/419.3; 198/429
(58) Field of Search ..... 198/418.7, 418.8, 198/419.1, 419.3, 429, 613, 614, 418.1

(56) References Cited

U.S. PATENT DOCUMENTS 4,098,392 * 7/1978 Greene ..... 198/419.3
4,936,077 * 6/1990 Langen et al. ..... 198/419.3 X

FOREIGN PATENT DOCUMENTS

2259769 * 8/1975 (FR) ..... 198/419.3
2379439 * 10/1978 (FR) ..... 198/419.3

* cited by examiner

*Primary Examiner*—James R. Bidwell
(74) *Attorney, Agent, or Firm*—Marger Johnson & McCollom, P.C.

(57) ABSTRACT

A conveying apparatus for conveying conveyance objects along a conveyance direction without positional slippage includes a conveyance line, a plurality of guide pins which move in the conveyance direction along the conveyance line and which are capable of reciprocal movement in a direction orthogonal to the conveyance direction, and a mechanism for moving prescribed guide pins selected from the plurality of guide pins in the orthogonal direction, wherein the guide pins are reciprocally movable between an operating position protruding over the conveyance line to enable the tips of the guide pins to come in contact with the conveyance objects, and a base position which does not protrude above the conveyance line.

11 Claims, 6 Drawing Sheets

CONVEYING APPARATUS

BACKGROUND OF THE INVENTION

1. Field of the Invention

The present invention relates to a conveying apparatus, and in particular relates to a conveying apparatus in which the configuration pitch of the conveying member (guide pin) is made roughly the same as the rear-to-front length of the conveyance objects (i.e., objects to be conveyed) in order to carry out efficient conveyance. Further, when arranged upstream from a packaging machine, the conveying apparatus can be utilized to supply products (i.e., objects to be packaged) to the packaging machine.

2. Description of the Prior Art

When a conveying apparatus is arranged upstream from a packaging machine to convey products and to supply such products in an ordered manner to the inside of a packaging film, the products need to be conveyed over a prescribed interval. In general, such a conveying apparatus is equipped with an endless chain having pushing fingers mounted at fixed intervals, in which the pushing fingers push against the rear side of the products to move them in the forward direction, whereby the products are conveyed. In this way, when the products are moved by being in a contact state with the pushing fingers, if the conveying interval of the products is set to match the configuration pitch of the pushing fingers, it is possible to convey the products over a prescribed interval.

Now, in order to accommodate a plurality of cut dimensions, the configuration pitch of the pushing fingers is normally set at a relatively long interval, and in this way, products having different lengths can be made to fit such configuration pitch.

However, the prior art conveying apparatus described above has the following problems. Namely, because the configuration pitch of the pushing fingers is longer than the rear-to-front length of the products, when a product is in a proper conveyance position with its rear end in contact with a pushing finger, there is open space between the front end of the product and the pushing finger positioned in front of the product. Accordingly, in cases where the products have rod or spherical shapes which make it easy for rolling motion to occur, or in the case where the products have low frictional resistance which makes it easy for sliding movement to occur, there is the risk that the products will move away from the rear pushing fingers and experience motion within the interval between the rear and front pushing fingers. If this happens, the conveyance interval of the products will be dispersed. Then, if the products are supplied to the inside of the packaging film, there is the risk that a sealing apparatus will bite into the products.

If the products have a rod shape, the backward and forward movement described above can be restricted by matching the axial direction of the products with the conveying direction. However, in cases where a plurality of relatively short rod-shaped objects such as dry batteries and the like are packed in a single package, the rod-shaped objects need to be lined up in an ordered manner between the pushing fingers, and each rod-shaped object must be conveyed with its axial direction arranged orthogonal to the conveying direction. As a result, the above-described problem of movement due to rolling of the products will occur.

Furthermore, because the configuration pitch of the pushing fingers is longer than the rear-to-front length of the products, the difference therebetween becomes wasted space, and this degrades the conveyance efficiency. Moreover, because the overall length of the endless chain on which the pushing fingers are mounted must be a whole number multiple of the configuration pitch of the pushing fingers, the design and construction thereof is troublesome. Accordingly, when the configuration pitch is to be changed, there are many cases where it becomes necessary to also change the overall length of the endless chain, and this makes it impossible to easily change the configuration pitch. As a result, in order to have general applicability, wasted space is accepted, and the configuration pitch is made long enough to accommodate the products.

However, because the interval for finally supplying the products to the inside of the packaging film must be made to match the cut dimension, if the configuration pitch of the pushing fingers is too long, the movement speed of the pushing fingers for matching the cut dimension must be made relatively faster than the movement speed of the packaging film.

Furthermore, in the case of conveyance objects that move easily, because the configuration pitch of the pushing fingers and the rear-to-front length of the objects need to be roughly matched, an exclusive conveying apparatus must be designed, and this leads to high costs. Further, with such arrangement it is not possible to easily carry out design changes to suit changes in the dimensions of the products and changes in the cut dimension.

SUMMARY OF THE INVENTION

In view of the background given above, it is an object of the present invention to solve the problems of the prior art described above by providing a conveying apparatus which makes it possible to set the configuration pitch of guide members for restricting backward and forward movement of conveyance objects at roughly the same value as the rear-to-front length of the conveyance objects in order to prevent the conveyance objects from slipping out of position in the backward and forward directions. Further, it is another object of the present invention to utilize such ability to set the configuration pitch at roughly the same value as the length of the conveyance objects to provide a general purpose conveying apparatus that can accommodate objects having different rear-to-front lengths. Furthermore, it is still another object of the present invention to provide a conveying apparatus which does not require the acquisition of the relationship between the configuration pitch of the pushing fingers and the moving distance (one cycle) of the guide members, and which simplifies design and makes it possible to freely select the overall length.

In order to achieve the objects stated above, the conveying apparatus according to the present invention is equipped with a conveyance line along which conveyance objects (referred to as "products 1" in the preferred embodiment) are conveyed, a plurality of guide pins capable of reciprocal movement in a direction orthogonal to the advancing direction, and means for moving appropriate guide pins freely selected from among the plurality of guide pins in such orthogonal direction to position guide members provided on the tips of the guide pins at either an operating position that lies above the conveyance line to enable the guide pins to make contact with the conveyance objects, or a base position which does not lie above the conveyance line (claim 1).

With this structure, by positioning prescribed guide pins at their operating positions to match the size of the conveyance objects to be conveyed, namely the rear-to-front length of the conveyance objects, it is possible to arrange the tips of the guide pins close to the front and back ends of the conveyance objects. Accordingly, it is possible to convey the conveyance objects while restricting positional slippage in the forwards and backwards directions thereof. Also, in the case where the dimensions of the conveyance objects are changed, the guide pins positioned at the operating position can be changed, and this makes it possible to match such dimensions. Furthermore, in the present embodiment, in addition to supplying a conveyance force to the conveyance objects (products 1) from the conveyance line 2, it is also possible to use the guide pins to supply a conveyance force. Further, prescribed guide pins from the guide pins that move along the conveyance line may be positioned at the operating position. Furthermore, each of the guide pins can be freely selected for movement. Accordingly, there is no need to know the relationship between the moving distance of one rotation cycle of the guide pins and the configuration pitch between the guide members of the tips of the guide pins at the operating position, and the configuration pitch does not need to be a whole number multiple. In other words, because the length of the entire apparatus can be decided without the need to consider the configuration pitch, the design thereof becomes easy.

Further, by means of a plurality of guides formed along the conveyance line, the conveying apparatus is preferably formed with a base path (referred to as "second path 21" in the preferred embodiment) for movement in the base position state, and an operating path (referred to as "first path 20" in the preferred embodiment) for movement in the operating position state followed by a return to the base path, and the conveying apparatus is preferably equipped with movement members mounted on the guide pins for movement inside the base path and the operating path, and guide means positioned at the junction of the base path and the operating path to guide the movement members into either the base path or the operating path (claim 2).

When constructed in this way, the guidance of the movement members into either of the paths is carried out only at the junction of the paths, and because movement thereafter follows the selected path, it is possible to use a simple structure for positioning selected guide pins at their operating positions.

In particular, if the guide means is constructed, for example, from a split cam having a circumferential protrusion and a driving mechanism to rotationally drive the split cam, by having the protrusion bias a guide pin in a prescribed direction, it is possible to guide the movement member thereof into either the base path or the operating path (claim 3).

Further, by forming one of the base path and operating path as a straight path and the other as a path that branches off from the junction of the two paths, and by biasing the advancing guide pin toward the branching path, it is possible to guide the guide pin in the branching path (claim 4).

In this regard, even though the preferred embodiment describes a straight base path (second path) and a branching operating path (first path), the present invention is not limited to this arrangement, and it is possible to reverse such arrangement by forming a straight operating path and a branching base path, or it is possible for both paths to be branching paths.

Furthermore, the conveying apparatus according to the present invention makes it possible to convey a plurality cylindrical conveyance objects that have been lined up sideways, such as dry batteries and the like (claim 5, 6).

Further, the conveying apparatus according to the present invention is not limited to inclusion in packaging machines. In other words, the conveyance objects are not limited to products. Further, although the conveyance objects were described in the preferred embodiment as being conveyed in units having a plurality of objects, it is of course possible to convey single objects.

Moreover, although the guide pins and the guide members were described as separate members in the preferred embodiment, the present invention is not limited to this, and it is possible for the guide pin and its guide member to be formed as a single integrated member.

DETAILED DESCRIPTION OF THE PREFERRED EMBODIMENTS

Figure 1:
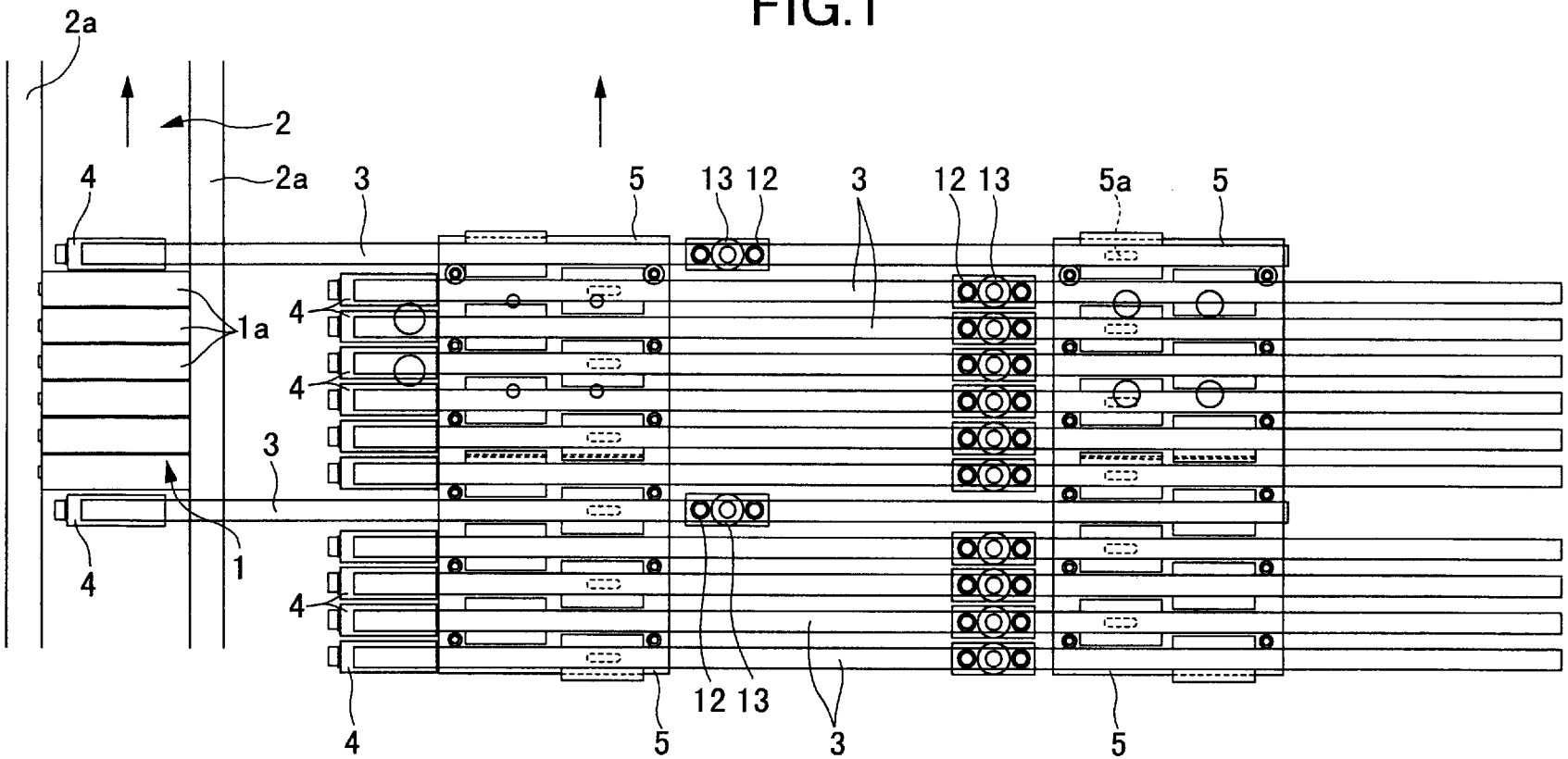
FIG. 1 is an enlarged plan view showing an essential portion of the preferred embodiment of a conveying apparatus according to the present invention.
Figure 2:
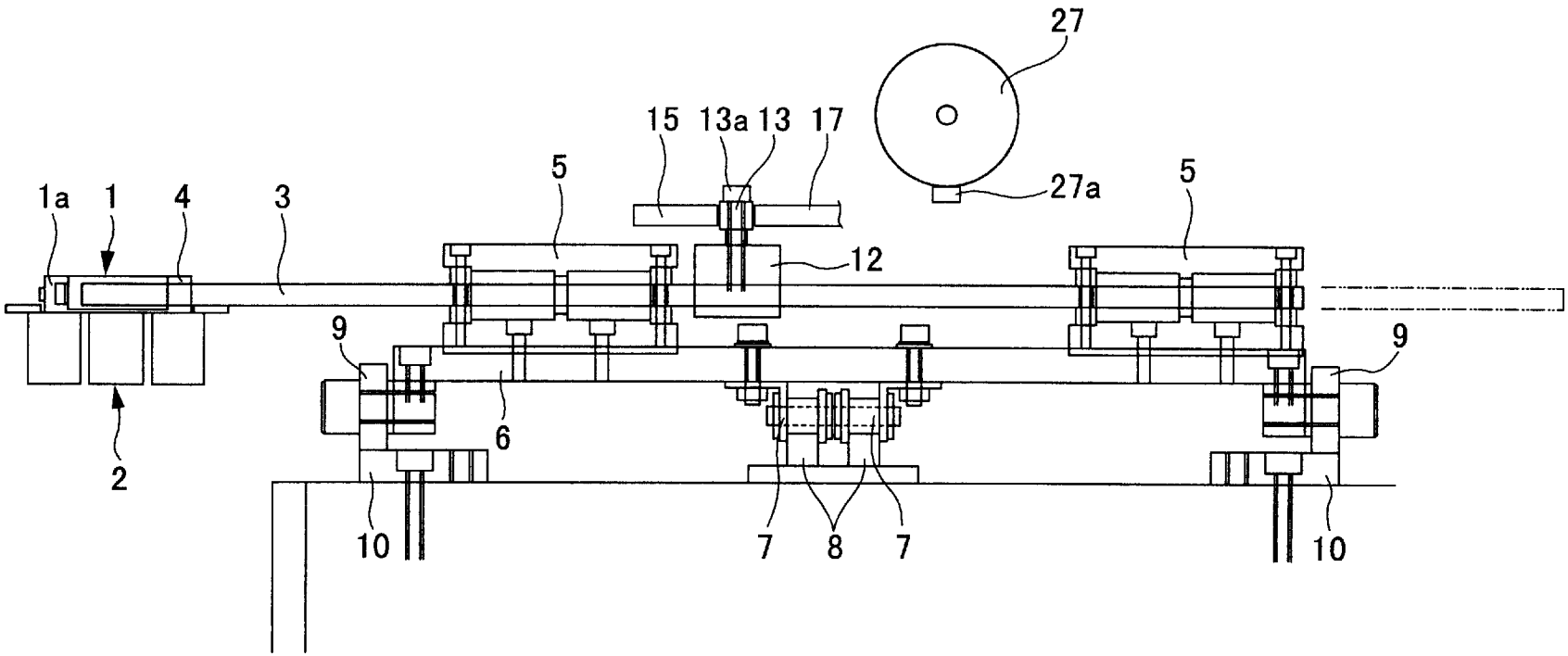
FIG. 2 is a front view of the conveying apparatus shown in FIG. 1.
Figure 3:
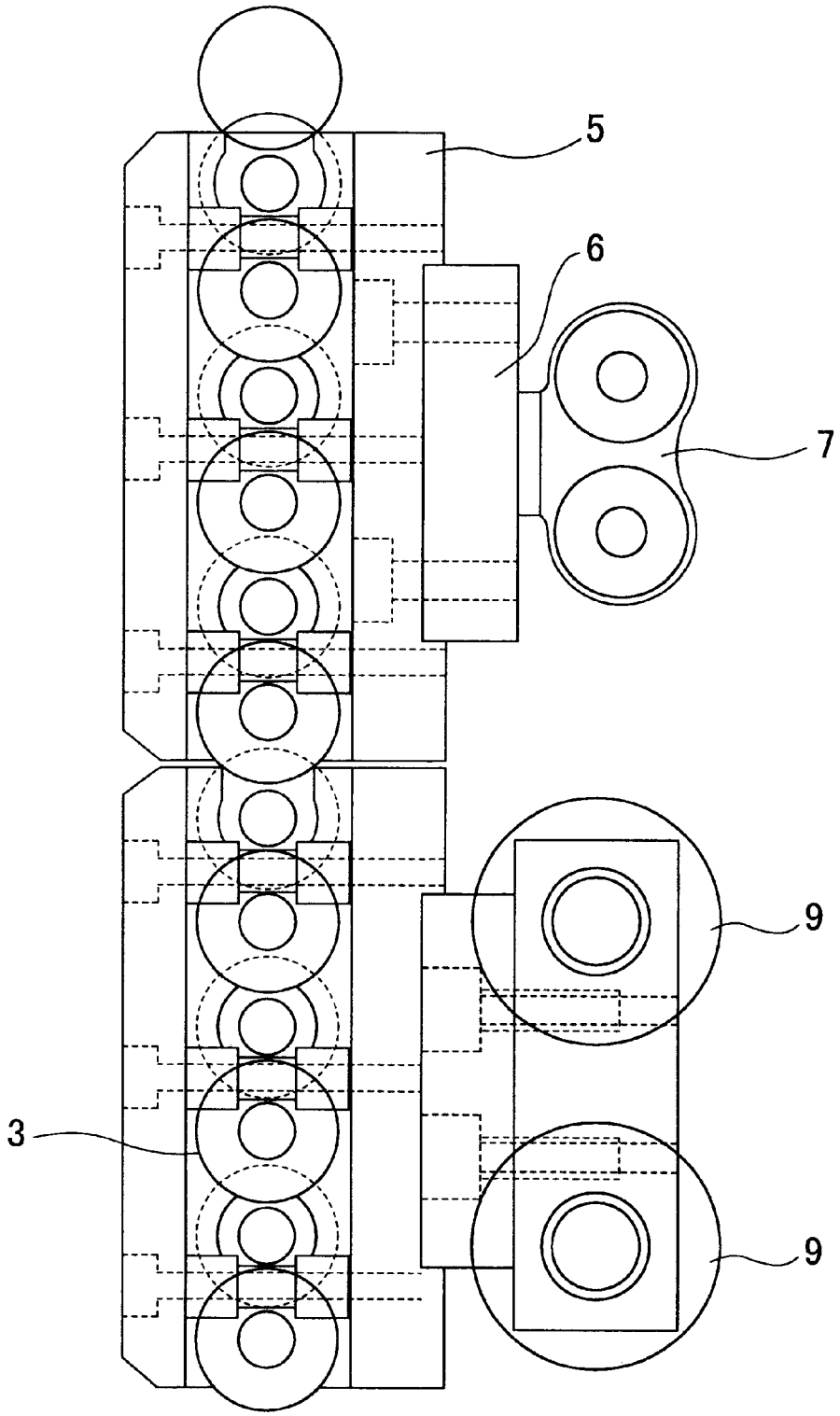
FIG. 3 is a side view of the conveying apparatus shown in FIG. 1.

FIGS. 1~3 show a preferred embodiment of a conveying apparatus according to the present invention. As shown in these drawings, in the present embodiment, as an example of products 1 which form conveyance objects, a plurality of dry batteries 1*a* is arranged sideways (i.e., the dry batteries 1 a are arranged with their axes orthogonal to the conveyance direction) on a conveyance line 2 so as to be conveyed over a prescribed interval. Further, sidewalls 2*a* are formed on both sides of the conveyance line 2 in the conveyance direction so as to restrict the dry batteries from moving in axial direction. Now, even though the conveyance line 2 may be a stationary body such as a plate or the like, in the present embodiment, the conveyance line 2 is preferably a belt conveyor, and in this way it becomes possible for the conveyance line 2 to also impart a conveyance force to move the products 1 in the forward direction.

In the present embodiment, a plurality of guide pins 3 capable of reciprocal movement in a direction orthogonal to the conveyance direction (i.e., the direction of forward movement) are provided to the side of the conveyance line 2, and mounted on the tips of the guide pins 3 are guide members 4 for restricting movement of the products 1 in the backward and forward directions. Further, the guide pins 3 move in the conveyance direction synchronized with the movement of the belt conveyor that forms the conveyance line 2, and the speed of such movement is the same as the movement speed of the products 1 on top of the conveyance line 2.

Further, by the reciprocal movement of the guide pins 3 in the axial direction, the guide members 4 provided on the tips of the guide pins 3 can be moved to either an operating position protruding over the conveyance line 2 to enable contact with the products 1, or a standby position (base position) which does not reach the space above the conveyance line 2. Now, because each guide pin 3 is constructed so as to be capable of independent reciprocal movement, by protruding a pair of guide pins 3 having an interval spacing roughly the same as the rear-to-front length of the products 1 over the conveyance line in order to position the guide members 4 thereof at their respective operating positions, as shown in FIG. 1, it is possible to hold the products 1 between such pair of guide members 4, and such interval can be freely selected.

Now, because the interval spacing of the pair of guide pins 4 described above is roughly the same as the rear-to-front length of the products 1, even if each of the dry batteries 1 a that form the products 1 try to move out of place in the backwards or forwards direction, the dry batteries 1*a* will come into contact with the pair of guide members 4 and such movement will be restricted. Further, because the guide pins 3 together with their respective guide members 4 move along the conveyance direction of the conveyance line 2 at the same speed as the movement speed of the products 1, the state shown in FIG. 1 is maintained as movement occurs in the forward direction. Accordingly, during conveyance of the products 1, the occurrence of positional slippage due to movement of the dry batteries 1*a* in the forward and backward directions can be restricted as much as possible, and this makes it possible to supply the products 1 in a sequential manner over a prescribed interval to the inside of packaging film of a packaging machine arranged downstream from the conveying apparatus.

Further, in the case where the number and/or battery type (battery size) of the dry batteries 1*a* that form the products 1 are changed, by protruding an appropriate pair of guide pins 3 having an interval spacing that roughly matches the rear-to-front length of the newly changed products 1 over the conveyance line 2 in order to position the guide members 4 thereof at their respective operating positions, it is possible to normally restrict the movement of the products 1 in the backward and forward directions.

Next, a description will be given for the mechanism which reciprocally moves the guide pins 3 and their respective guide members 4. First, the guide pins 3 are supported by two shaft bearings 5, 5 arranged in the axial direction, and by being guided by the shaft bearings 5, the guide pins 3 are able to move in the thrust direction. Formed in these shaft bearings 5 are keys 5*a*, and by coupling these keys 5*a* with the guide pins 3, it is possible to prevent rotation of the guide pins 3.

Further, the shaft bearings 5 are fixed with screws or the like to an intermediate plate 6, and this entire assembly is made to be movable. Namely, the middle of the bottom of the intermediate plate 6 is mounted on an endless chain 7, and both side edges of the bottom of the intermediate plate 6 are provided with bearings 9. Furthermore, the endless chain 7 and the bearings 9 are respectively in contact with guide rails 8 and 10, and this enables stable movement thereabove. Further, the endless chain 7 meshes with chainwheels (described below) at both ends along the backwards and forwards directions, and this enables the assembly to receive a conveyance force.

Figure 4:
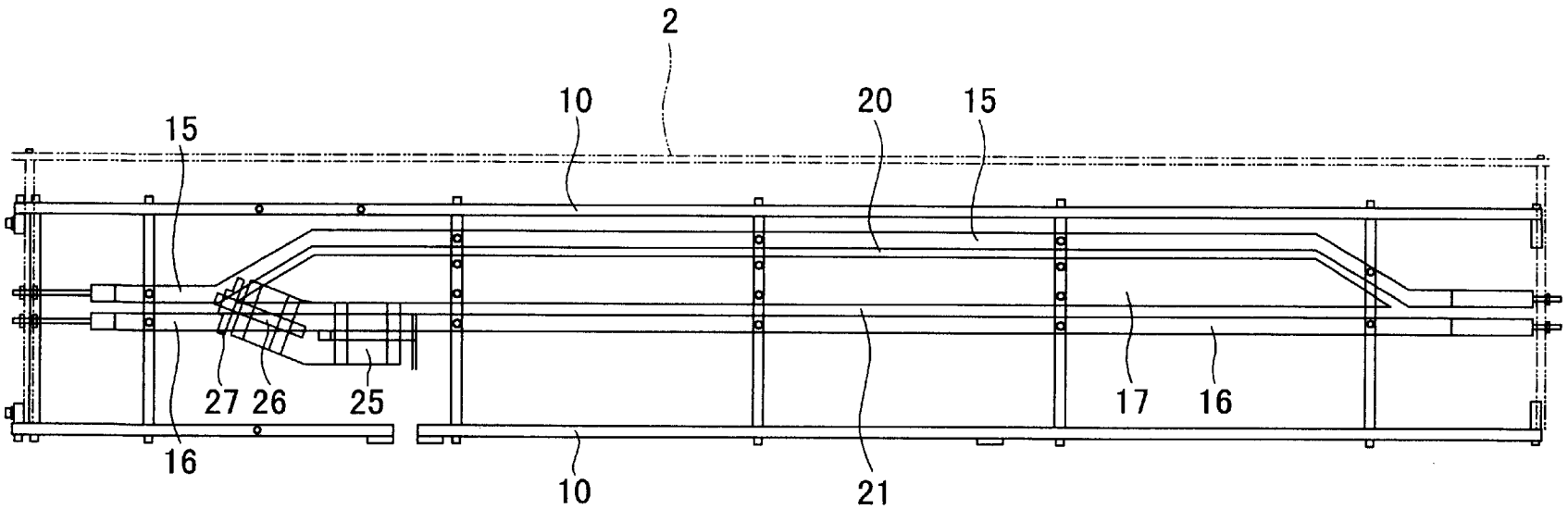
FIG. 4 is a plan view showing the mechanism for reciprocally moving the guide pins.
Figure 5:
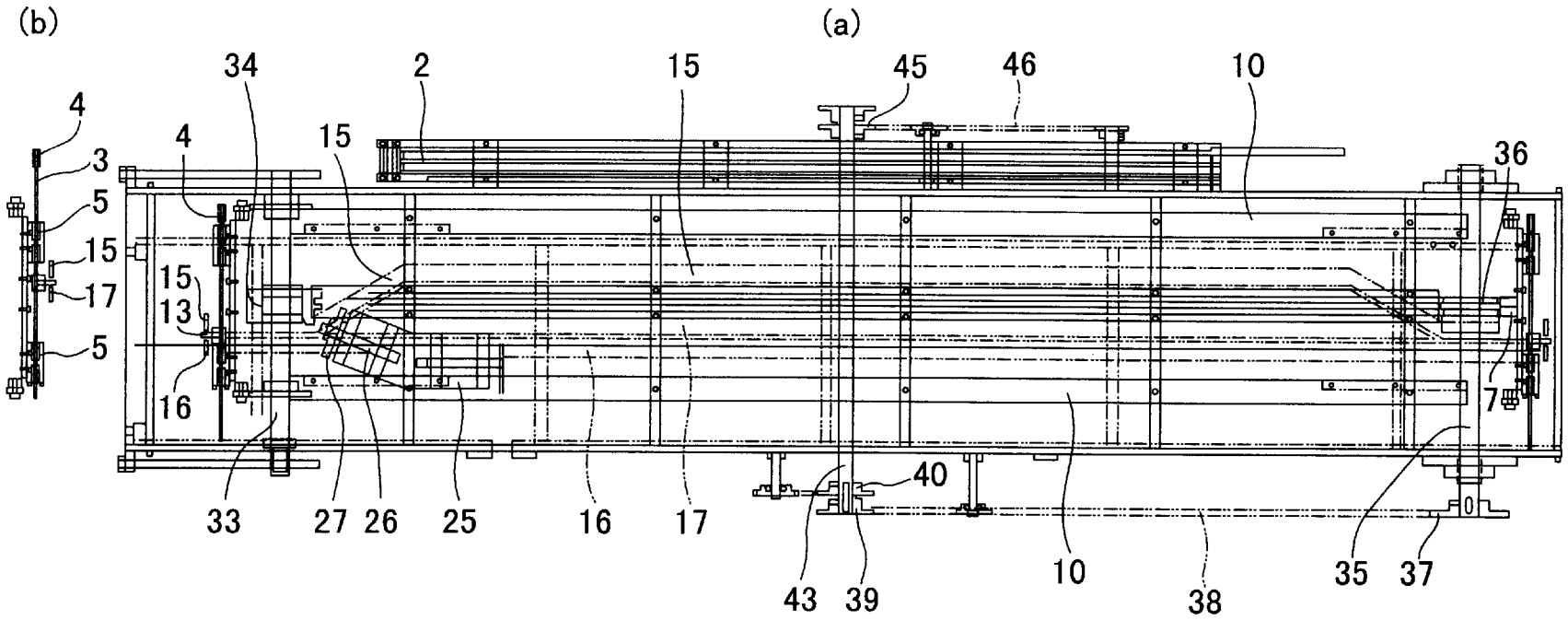
FIG. 5(*a*) is a plan view showing the preferred embodiment of a conveying apparatus according to the present invention, and FIG. 5(*b*) is a side view thereof.

Further, mounts 12 are fixed to the guide pins 3 on the parts thereof that lie between both shaft bearings 5, 5, and bearings 13 are fastened with screws or the like to the middle of the top surfaces of the mounts 12. In this way, the bearings 13 are freely rotatable around the axis of rotation of the screws. Also, as shown in FIGS. 4 and 5, because the bearings 13 enable movement along either a first path 20 or a second path 21 formed by a first guide plate 15, a second guide plate 16 and an intermediate guide plate 17, the guide pins 3 can be moved in a reciprocal manner, and this makes it possible to move the guide members 4 at the ends of the guide pins 3 to either an operating position or a base position.

Namely, the first path 20 which functions as an operating path is formed between the first guide plate 15 and the intermediate guide plate 17, and the second path 21 which functions as a base path is formed between the second guide plate 16 and the intermediate guide plate 17. In particular, by giving the second guide plate 16 a linear shape, the second path 21 is made into a straight path that continues without change toward the back end. Moreover, the second path 21 is arranged parallel to the conveyance line 2. On the other hand, the first path 20 starts out by branching away from the second path 21 toward the conveyance line 2, and then runs parallel to the conveyance line 2, and in this way the first path 20 ends up running parallel with the second path 21.

In this way, when the bearing 13 is moved inside the second path 21, the guide pin 3 will be maintained at the base position, and when the bearing 13 is moved inside the first path 20, because the position of the bearing 13 gradually approaches the conveyance line 2, this will cause the guide pin 3 to protrude in a way that positions the guide member 4 at the operating position.

Further, the passage into either the first path 20 or the second path 21 is carried out by a split cam 27 fixed to a rotation axle 26 mounted on the output shaft of a driving motor 25. As shown in FIG. 4, the split cam 27 is provided at the junction of the first path 20 and the second path 21, and as shown in FIG. 2, the split cam 27 has a disc shape with a single protrusion 27*a* formed on a portion of the outer circumferential surface thereof. Further, the protrusion 27*a* is capable of coming into contact with an upper end portion 13*a* of the bearing 13 provided on the guide pin 13.

In this way, if the split cam 27 is rotated (in the clockwise direction in FIG. 2) at a prescribed timing, the protrusion 27*a* will bias the upper end portion 13*a* of the bearing 13 toward the conveyance line 2 (guide member 4). When this happens, because the bearing 13 that receives the biasing force will proceed to move while in a biased state toward the first guide plate 15, the bearing 13 will enter the first guide path 20, and because the bearing 13 will thereafter proceed along the first path 20, the guide pin 3 will gradually protrude, and then with guide member 4 positioned over the conveyance line 2 (the state shown by FIG. 5 (*b*) ), the guide pin 3 is moved over a prescribed interval in the conveyance direction, and then after this the bearing 13 is retracted and passes through the second path 21.

On the other hand, in the case where the upper end portion 13*a* of the bearing 13 is not biased by the protrusion 27*a*, the bearing 13 proceeds to move in an unaltered state through the second path 21. In this connection, so long as it is possible to bias the upper end portion 13*a* of the bearing 13 at the junction of the first and second paths 20, 21 in accordance with a prescribed timing, mechanisms other than a split cam can be utilized, such as a cylinder or a solenoid.

Further, the endless chain 7 mounted with the plurality of guide pins 3 is suspended between a driven chainwheel 34 mounted to the middle of a driven axle 33 arranged at the conveyance entrance side (after the advancing direction), and a driving chainwheel 36 mounted to the middle of a driving axle 35 arranged at the conveyance exit side (before the advancing direction), and in this way the endless chain 7 also rotates when the driving axle 35 is rotated, and this causes the guide pins 3 to also move along the conveyance direction.

Also, the end of the driving axle 35 is provided with a gear wheel 37 which is connected by means of a power transfer chain 38 to a gear wheel 39 mounted on the end of relay rotation axle 43, and another gear wheel 40 mounted on the relay rotation axle 43 is connected by means of a power transfer chain 41 to a gear wheel 42 connected to the output shaft of a driving motor. In this way, when the driving motor rotates, such torque is transferred via the two power transfer chains 41, 38 to the gear wheel 37 mounted on the driving axle 35, whereby the driving axle 35 and the driving chainwheel 36 are rotated, and this in turn rotates the endless chain 7.

Figure 6:
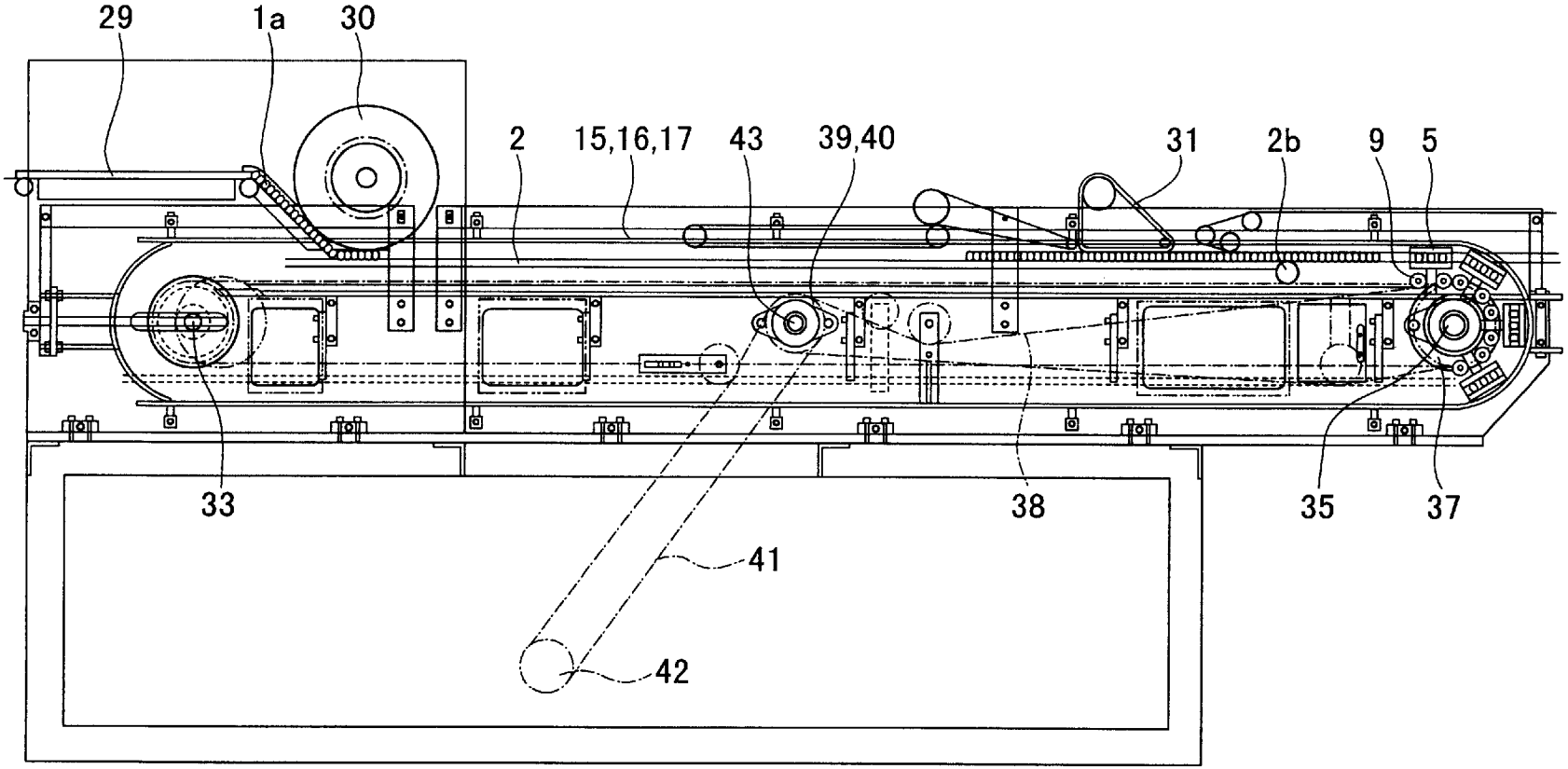
FIG. 6 is a front view of the conveying apparatus shown in FIG. 5.

Furthermore, as shown in FIG. 6, a conveyor belt 29 for sequentially conveying products is provided at the conveyance entrance side of the conveyance line 2 at a raised step position, a downward sloping chute 29*a* is arranged at the end of the conveyor belt 29, and a star wheel 30 is provided above the chute 29*a* to make it possible to supply the dry batteries 1*a* onto the conveyance line 2 in a regular sideways arrangement. Further, an endless belt 31 is provided above the conveyance exit side to provide a downward force on the dry batteries 1 a so as to make it possible to smoothly supply the dry batteries 1*a* to a packaging machine (i.e., to the inside of packaging film) arranged downstream.

Further, the driving force for driving the endless chain 31 is also obtained from the driving motor that drives the endless chain 7 described above. Namely, torque is supplied from the gear wheel 45 mounted on the other end of the relay rotation axle 43 via the power transfer chain 46.

Now, in the embodiment described above, after advancing along the conveyance line 2, the rotation path of the guide pins 3 moves downward and passes through a lower space, and then retraction takes place to prepare for the next conveyance, but this may be reversed, with the advancing guide pins passing through an upper space for retraction.

As described above, in the conveying apparatus according to the present invention, because guide pins provided with guide members on their tips are independently made to be reciprocally movable, by positioning appropriate guide pins at their operating positions so as to match the rear-to-front length of the conveyance objects to be conveyed, the configuration pitch of the guide members for restricting backward and forward movement of the conveyance objects can be made roughly the same. As a result, it is possible to restrict positional slippage of the conveyance objects in the backward and forward directions. Furthermore, in the case where the rear-to-front length of the conveyance objects is changed, the protruding guide pins can be changed to make the configuration pitch roughly the same as the newly changed rear-to-front length, whereby the general applicability is increased. Further, because there is no need to obtain the relationship between the configuration pitch and the moving distance (one cycle) of the guide members, designing the conveying apparatus is easy and this makes it possible to freely select the overall length.

What is claimed is:

1. A conveying apparatus, comprising:

a conveyance line for conveying conveyance objects in a conveyance direction;

a plurality of guide pins which move in the conveyance direction along the conveyance line, the guide pins being reciprocally movable in a direction orthogonal to the conveyance line, and the guide pins being provided with guide members on the tips thereof; and means for moving prescribed guide pins selected from the plurality of guide pins in the orthogonal direction;

wherein the guide pins are reciprocally movable between an operating position protruding over the conveyance line to enable guide members on the tips of the prescribed guide pins to come in contact with the conveyance objects, and a base position which does not protrude above the conveyance line.

2. The conveying apparatus of claim 1, wherein a plurality of guides is formed along the conveyance line so as to form a base path for movement in the base position state and an operating path for movement in the operating position state followed by a return to the base path, and further comprising movement members mounted on the guide pins for movement inside the base path and the operating path, and guide means positioned at a junction of the base path and the operating path to guide the movement members into either the base path or the operating path.

3. The conveying apparatus of claim 2, wherein the guide means includes a split cam having a circumferential protrusion and a driving mechanism to rotationally drive the split cam, in which the protrusion biases a guide pin in a prescribed direction to guide the movement member thereof into either the base path or the operating path.

4. The conveying apparatus of claim 2, wherein one of the base path and operating path is a straight path and the other path is a branching path which branches off from a junction point, and wherein the guide means biases an advancing guide pin toward the branching path in order to guide the guide pin into the branching path.

5. The conveying apparatus of claim 1, wherein the conveyance objects are a plurality of cylindrical objects that are lined up sideways on the conveyance line.

6. The conveying apparatus of claim 5, wherein the cylindrical objects include batteries.

7. The conveying apparatus of claim 1, wherein the conveyance objects are cylindrical objects, wherein a longitudinal axis of each of the cylindrical objects is parallel to the conveyance line and orthogonal to the conveyance direction.

8. A conveying apparatus, comprising:

a conveyance line for conveying conveyance objects in a conveyance direction;

a plurality of guide pins which move in the conveyance direction along the conveyance line, the guide pins being reciprocally movable in a direction orthogonal to the conveyance line, and the guide pins being provided with guide members on the tips thereof;

means for moving prescribed guide pins selected from the plurality of guide pins in the orthogonal direction;

movement members mounted on the guide pins for movement inside the base path and the operating path; and guide means positioned at a junction of the base path and the operating path to guide the movement members into either the base path or the operating path, said means including a split cam having a circumferential protrusion and a driving mechanism to rotationally drive the split cam, in which the protrusion biases a guide pin in a prescribed direction to guide the movement member thereof into either the base path or the operating path;

wherein the guide pins are reciprocally movable between an operating position protruding over the conveyance line to enable guide members on the tips of the prescribed guide pins to come in contact with the conveyance objects, and a base position which does not protrude above the conveyance line; and wherein a plurality of guides is formed along the conveyance line so as to form a base path for movement in the base position state and an operating path for movement in the operating position state followed by a return to the base path.

9. The conveying apparatus of claim 8, wherein one of the base path and operating path is straight path and the other is a branching path which branches off from a junction point, and wherein the guide means biases an advancing guide pin toward the branching path in order to guide the guide pin into the branching path.

10. The conveying apparatus of claim 8, wherein the conveyance objects are a plurality of cylindrical objects that are lined up sideways on the conveyance line.

11. The conveying apparatus of claim 10, wherein the cylindrical objects include batteries.

* * * * *

UNITED STATES PATENT AND TRADEMARK OFFICE

CERTIFICATE OF CORRECTION

PATENT NO. : 6,253,903 B1
DATED : July 3, 2001
INVENTOR(S) : Takahashi

It is certified that error appears in the above-identified patent and that said Letters Patent is hereby corrected as shown below:

Column 4,
Line 39, "batteries 1 a" should read -- batteries 1a --

Column 5,
Lines 13-14, "batteries 1 a" should read -- batteries 1a --
Line 43, "bearings 5, 5" should read -- bearings 5,5 --
Line 62, "bearings 5, 5" should read -- bearings 5,5 --

Column 6,
Line 35, "guide pin 13" should read -- guide pin 3 --

Column 7,
Line 22, "batteries 1 a" should read -- batteries 1a --

Signed and Sealed this

Thirtieth Day of April, 2002

*Attest:*

*Attesting Officer*

JAMES E. ROGAN
*Director of the United States Patent and Trademark Office*